US005904186A

United States Patent [19]

Steiner

[11] Patent Number: 5,904,186

[45] Date of Patent: May 18, 1999

[54] SERIES SHED WEAVING MACHINE FOR WEAVING MULTIPLE WEB PANELS ON A SINGLE ROTOR

[75] Inventor: Alois Steiner, Rieden, Switzerland

[73] Assignee: Sulzer Rueti Ag, Rueti, Switzerland

[21] Appl. No.: 08/952,483

[22] PCT Filed: Apr. 26, 1996

[86] PCT No.: PCT/CH96/00158

§ 371 Date: Nov. 19, 1997

§ 102(e) Date: Nov. 19, 1997

[87] PCT Pub. No.: WO96/38609

PCT Pub. Date: Dec. 5, 1996

[30] Foreign Application Priority Data

Jun. 2, 1995 [CH] Switzerland ..... 1637/95

[51] Int. Cl.[6] ..... D03D 33/00; D03D 47/00

[52] U.S. Cl. ..... 139/28; 139/101; 139/435.3

[58] Field of Search ..... 139/28, 435.3, 139/101

[56] References Cited

U.S. PATENT DOCUMENTS

| | | | |
|---|---|---|---|
| 3,734,143 | 5/1973 | Svaty | 139/435.3 |
| 4,425,946 | 1/1984 | McGinley | 139/11 |
| 4,838,321 | 6/1989 | Ishido et al. | 139/20 |
| 5,146,955 | 9/1992 | Steiner et al. | 139/450 |
| 5,349,990 | 9/1994 | Gacsay | 139/194 |
| 5,439,037 | 8/1995 | Christe | 139/28 |

FOREIGN PATENT DOCUMENTS

| | | | |
|---|---|---|---|
| 0 258 887 | 3/1988 | European Pat. Off. . | |
| 0 433 216 A1 | 6/1991 | European Pat. Off. . | |
| 0 592 749 | 10/1992 | European Pat. Off. | 139/28 |
| 0 582 763 A1 | 2/1994 | European Pat. Off. . | |
| 2064236 | 7/1971 | France . | |
| 2 390 526 | 12/1978 | France . | |

*Primary Examiner*—Andy Falik

*Attorney, Agent, or Firm*—Townsend and Townsend and Crew LLP

[57] ABSTRACT

An improved series shed weaving machine includes a weaving rotor driven to rotate a plurality of mutually spaced-apart shed-forming sections for receiving warp threads. A plurality of separate weft thread presentation devices separately supply weft threads to only one of the plurality of spaced-apart shed-forming sections for weaving a separate web from the warp threads and the weft threads. Each spaced-apart shed-forming section includes a plurality of shed-forming elements which put the received warp threads into high and low positions to form a plurality of sheds which are open simultaneously so that a plurality of weft threads are simultaneously inserted into the plurality of sheds between the warp threads to weave the separate web.

13 Claims, 4 Drawing Sheets

SERIES SHED WEAVING MACHINE FOR WEAVING MULTIPLE WEB PANELS ON A SINGLE ROTOR

BACKGROUND OF THE INVENTION

The invention relates to a method for inserting weft threads in a series shed weaving machine. The invention relates further to a series shed weaving machine for inserting the thread.

A series shed weaving machine for simultaneously inserting a plurality of weft threads into a shed-forming weaving rotor is known from EP 0 433 216 B1. The known roller-shaped weaving rotor is equipped with shed-forming elements which place the warp threads into a high shed position or a low shed position respectively so that a shed results through which a weft thread can be inserted by means of air. A plurality of such sheds is always open at the surface of the weaving rotor so that weft threads can be inserted simultaneously through each open shed.

This known series shed weaving machine has the disadvantage that its weft insertion performance is limited. The insertion performance is limited in particular by the maximum number of simultaneously open sheds, by the time required for the infeed of the warp threads into the shed-forming elements, as well as by the maximum permissible weft insertion velocity as a result for example of the strength of the weft thread to be woven.

SUMMARY OF THE INVENTION

The object of the present invention is to improve the weft insertion performance.

The inventive process for producing a cloth by means of a series shed weaving machine having a weaving rotor is carried out in such a manner that at least two separated webs are arranged on the weaving rotor, and that at least two of the webs are supplied with separate weft threads, respectively fed to only one of the webs in each case. Two weft thread presentation devices can be placed for example in the region of the two end surfaces of the weaving rotor so that the weft threads departing from these regions are inserted from both sides and move towards the middle of the weaving rotor. Furthermore, the two weft thread presentation devices can supply the weft thread to the weaving rotor between two separated webs, with the weft threads moving in opposite directions, each being inserted into one of the two webs. The weft threads can also be inserted moving in the same direction by having the one weft thread presentation device supply the weft thread to the weaving rotor at one end face and a second weft thread presentation device supply the weft thread to the weaving rotor between the two spaced apart webs. The series shed weaving machine can also have a weaving rotor with more than two spaced apart webs. Furthermore, the series shed weaving machine can also have more than two weft thread presentation devices.

Such a method and such an apparatus have the advantage that the weaving production of the series shed weaving machine can be doubled or multiplied while holding the rotational speed constant.

DESCRIPTION OF THE PREFERRED EMBODIMENTS

Figure 1A:
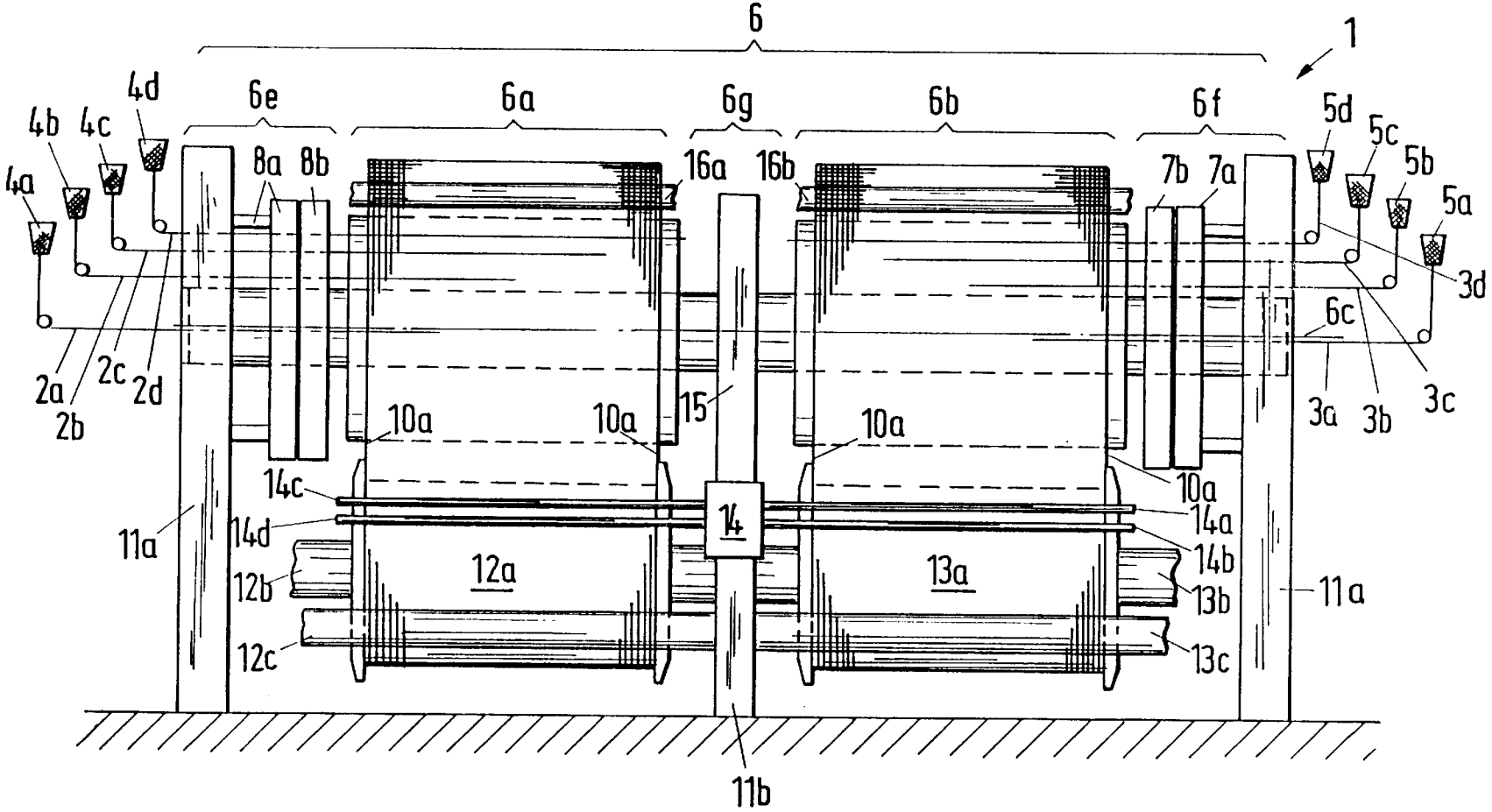
FIG. 1*a* is a front view of a double web series shed weaving machine.
Figure 2:
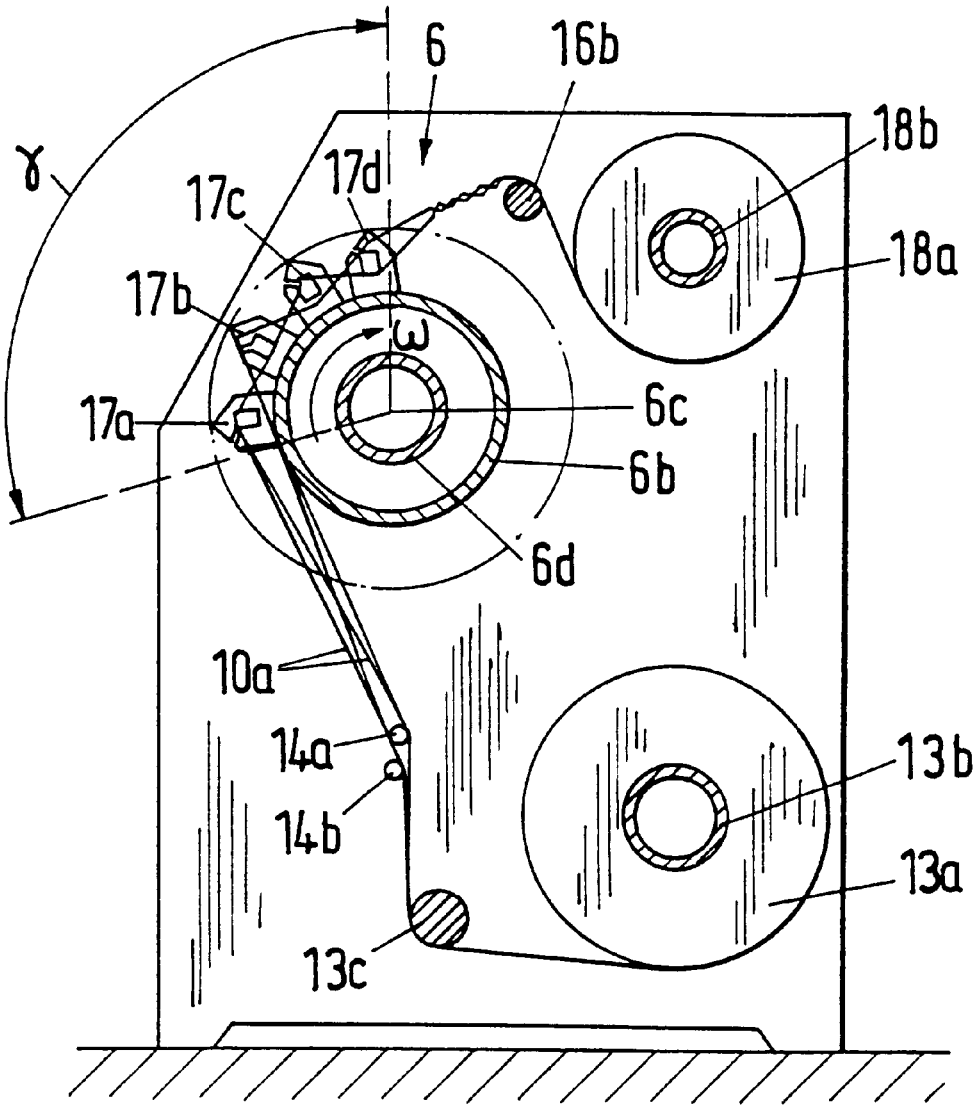
FIG. 2 is a side view of the series shed weaving machine.

FIG. 1*a* shows a front view of a series shed weaving machine 1 with a weaving rotor 6, which has shed-forming sections 6*a*, 6*b* equipped with shed-forming elements 17*a* in accordance with FIG. 2. The weaving rotor 6 has a centrally extending shaft with a center of rotation 6*c*. The two shed-forming sections 6*a*, 6*b* are spaced apart in the direction of extent of the center of rotation 6*c*. The weaving rotor 6 has end sections 6*e*, 6*f* at both ends which are supported by holding devices 11*a*. The end sections 6*e*, 6*f* each have in addition a weft thread transfer device 7*a*, 7*b*; 8*a*, 8*b* in order to associate an open weaving shed with each of the supplied weft threads 2*a*, 2*b*, 2*c*, 2*d*; 3*a*, 3*b*, 3*c*, 3*d*. The series shed weaving machine 1 shown has in addition a middle support 11*b* with a middle bearing 15 for the weaving rotor 6.

Figure 1B:
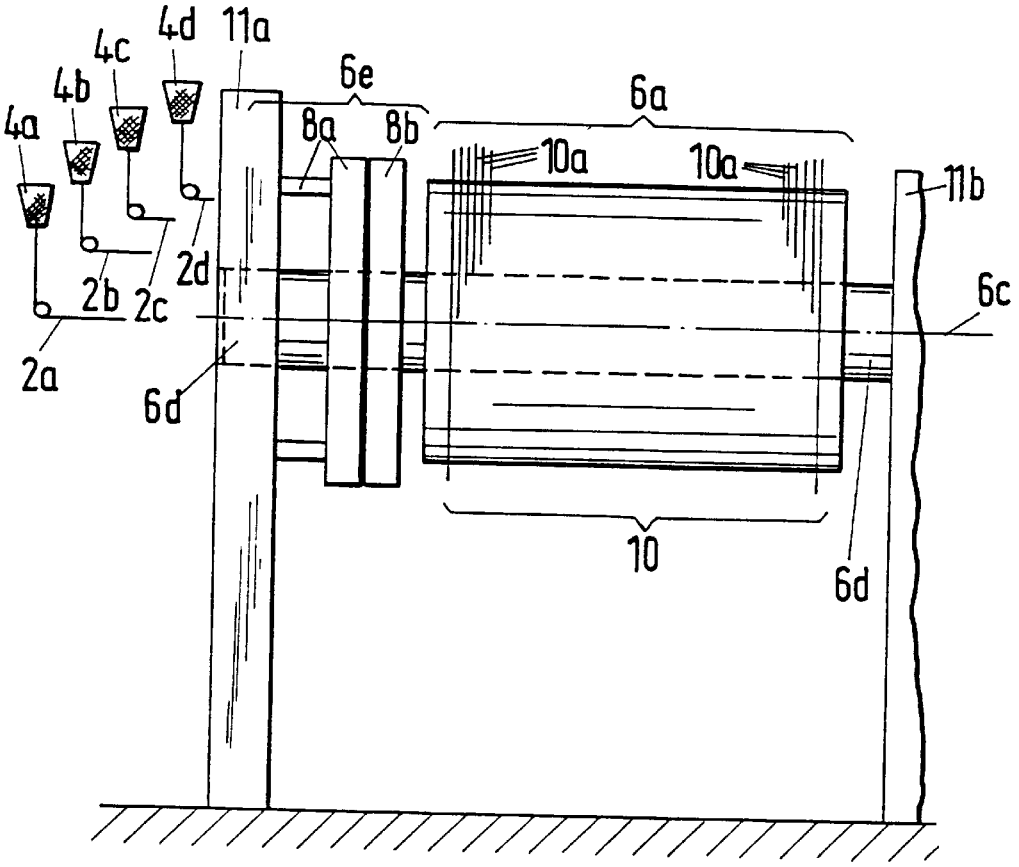
FIG. 1*b* is a front view of a part of the series shed weaving machine.

As shown in FIG. 1*b*, warp threads 10*a* are arranged over a partial breadth of the shed-forming section 6*a*. The totality of these warp threads 10*a* form a web 10. The supply of warp threads 10*a* is stored on the warp beam 13*a*, as shown schematically in FIG. 2, with the warp beam 13*a* being journalled by a shaft 13*b*. Starting from the warp beam 13*a*, the warp threads 10*a* proceed over a deflection beam 13*c* and over laying-in members 14*a*, 14*b*, 14*c*, 14*d* as well as over the shed-forming weaving rotor 6 to the deflection beam 16*b* and further on to the cloth beam 18*a*, which is journalled on a shaft 18*b*. The weaving rotor 6, rotating in the direction of rotation ω, has an axle of rotation 6*d* as well as a shed-forming section 6*b* which is equipped with shed-forming elements 17*a*, 17*b*, 17*c*, 17*d*. The shed-forming elements put the warp threads into high and low positions respectively so that a shed is formed, through which a weft thread 2*a*, 3*a* can be inserted. A characteristic of the series shed weaving machine is that a plurality of sheds extending in the direction of the center of rotation 6*c* are open at the same time so that a plurality of weft threads can be simultaneously inserted between the warp threads 10*a*. The warp threads 10*a* encircle a certain angular region of the weaving rotor 6, which is designated as the angle of wrap γ. The angle of wrap γ is chosen in the present exemplary embodiment to be sufficiently large that four sheds proceeding in the direction of the center of rotation 6*c* are open at the same time. The angle of wrap γ and/or the arrangement of the shed-forming elements 17*a*, 17*b*, 17*c*, 17*d* can also be chosen such that more or fewer than four simultaneously opened sheds result. The maximum possible angle of wrap is limited in particular by the yarn properties of the warp threads 10*a*. The more shed-forming elements 17*a*, 17*b*, 17*c*, 17*d* that are distributed in the direction of rotation of the weaving rotor 6 at which warp threads lie in contact, the greater is the frictional force exerted by the shed-forming elements 17*a* to 17*d* on the warp threads 10*a*. This force must be held to within certain limits, so that the angle of wrap γ cannot be chosen arbitrarily large. In order to nevertheless substantially increase the weft insertion performance, a second shed-forming section 6*b* is placed adjacent to the one shed-forming section 6*a* as shown in FIG. 1*a*, with the two shed-forming sections 6*a*, 6*b* being supplied with weft threads 2*a*, 2*b*, 2*c*, 2*d*; 3*a*, 3*b*, 3*c*, 3*d* by separate weft thread insertion devices.

In FIG. 1*a* the weft thread insertion devices 4*a*–*d* and 5*a*–*d* are respectively placed at a side face of the weaving rotor 6 in such a manner that the weft threads 2*a* to 2*d* and 3*a* to 3*d* are respectively inserted starting at the end sections 6*e* and 6*f* and moving in opposite directions toward the middle section 6*g* of the weaving rotor.

Figure 1C:
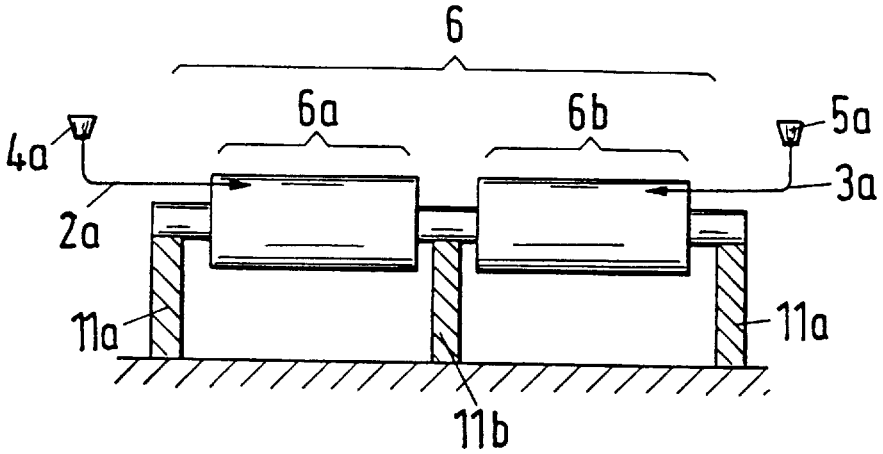
FIGS. 1*c*, 1*d*, 1*e* illustrate various possibilities for arranging a weft thread presentation device.

Such a weft thread insertion is again shown schematically simplified in FIG. 1*c*.

Figure 1D:
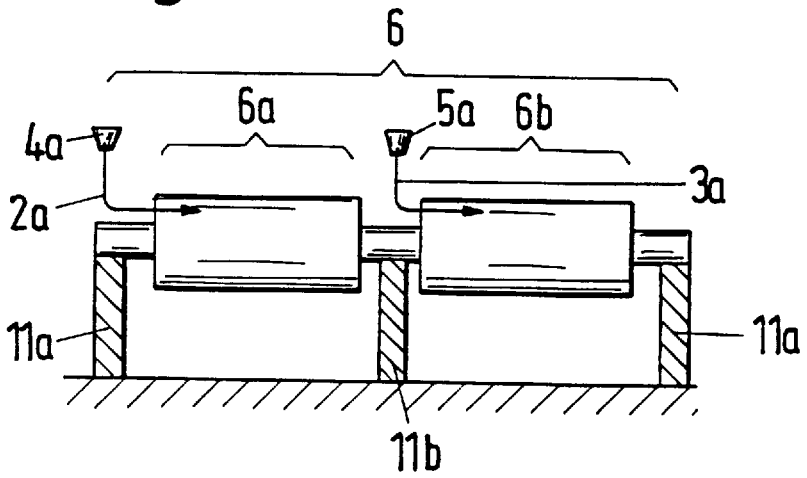

FIG. 1*d* shows a further possibility for a weft thread insertion in accordance with the invention in which the weft threads 2*a*, 3*a* are inserted moving in the same direction, with the one weft thread insertion device 4*a* placed at the end section 6*e* inserting the weft thread 2*a* into the shed-forming section 6*a*, and with the second weft thread transfer device 5*a* between the shed-forming sections 6*a*, 6*b* inserting the weft thread 3*a* into the shed-forming section 6*b* of the weaving rotor 6.

Figure 1E:
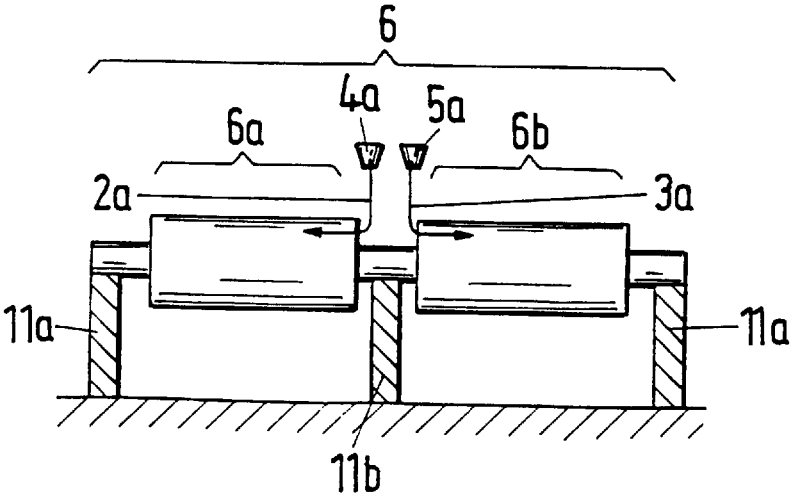

FIG. 1*e* shows a further exemplary embodiment of a weft thread insertion in which the weft thread transfer devices 4*a*, 5*a* are placed between the shed-forming sections 6*a*, 6*b*, with the weft threads 2*a*, 3*a* being inserted moving toward the end sections 6*e*, 6*f* in opposite directions.

The warp threads 10*a* run over laying-in members 14*a*, 14*b*, 14*c*, 14*d* which are moved by a drive 14 in such a manner that the warp threads are inserted into the shed-forming elements 17*a*, 17*b*, 17*c*, 17*d* in such a manner that they either lie on the shed-forming element and thus form a high point or are led between the laterally spaced shed-forming elements 17*a*, 17*b*, 17*c*, 17*d* and thus form a low point so that an open shed results.

Each of the series shed weaving machines in the exemplary embodiments described has one weaving rotor 6 with two shed-forming sections 6*a*, 6*b*. It is naturally also possible to execute a weaving rotor with more than two shed-forming sections 6*a*, 6*b*. These shed-forming sections can be supplied with weft threads 2*a*, 3*a* as illustrated in FIGS. 1*c*, 1*d*, 1*e*, where the separately inserted weft threads 2*a*, 3*a* are inserted moving in opposite directions or in the same direction. In the case of more than two shed-forming sections 6*a*, 6*b* it is in addition possible to use more than two weft thread presentation devices, so that the maximum number of separate weft threads are fed in for each shed-forming section 6*a*, 6*b*, 6*c*, 6*d*.

The weft insertion performance of a series shed weaving machine can thereby be increased twice or a plurality of times relative to a known series shed weaving machine. The weft threads 2*a*, 2*b*, 2*c*, 2*d* are advantageously inserted synchronously to an angle of rotation ω determined by the position of the weaving rotor, with the weft thread tips having penetrated to differing extents into the shed-forming sections 6*a*. In an advantageous embodiment of the weaving rotor 6, the shed-forming members 17*a* are arranged in such a manner that the sheds developed by adjacent shed-forming sections 6*a*, 6*b* extend in a straight line in the direction of the extent of the center of rotation 6*c*. If a machine is constructed symmetrically, as shown in FIG. 1*a*, then two weft threads 2*a*, 2*b* inserted into the same shed can be inserted at the same time, or synchronized timewise.

What is claimed is:

1. A series shed weaving machine comprising:

a weaving rotor having a plurality of mutually spaced-apart shed-forming sections, each spaced-apart shed-forming section being driven in rotation by the weaving rotor for receiving warp threads; and a plurality of separate weft thread presentation devices operatively coupled with the weaving rotor, each weft thread presentation device configured for separately supplying weft threads to only one of the plurality of spaced-apart shed-forming sections which corresponds to the weft thread presentation device for weaving a separate web from the warp threads and the weft threads.

2. A series shed weaving machine in accordance with claim 1 wherein the plurality of separate weft thread presentation devices are arranged with respect to the longitudinal extent of the weaving rotor in such a manner that the weft threads supplied by the plurality of separate weft thread presentation devices move in the same direction.

3. A series shed weaving machine in accordance with claim 1 further comprising at least one support device each disposed between a pair of neighboring spaced-apart shed-forming sections for supporting the weaving rotor.

4. A series shed weaving machine in accordance with claim 3 wherein one support device is disposed between each pair of neighboring spaced-apart shed-forming sections for supporting the weaving rotor.

5. A series shed weaving machine in accordance with claim 1 wherein the plurality of separate weft thread presentation devices are arranged symmetrically with respect to the longitudinal extent of the weaving rotor.

6. A series shed weaving machine in accordance with claim 1 wherein the weaving rotor includes two spaced-apart shed-forming sections, and wherein one weft thread presentation device is disposed between the two spaced-apart shed-forming sections and another weft thread presentation device is disposed at an end section of the weaving rotor.

7. A series shed weaving machine in accordance with claim 1 wherein the weaving rotor includes two spaced-apart shed-forming sections, and wherein two separate weft thread presentation devices are disposed between the two spaced-apart shed-forming sections.

8. A series shed weaving machine in accordance with claim 1 wherein each of the plurality of spaced-apart shed-forming sections includes a plurality of shed-forming elements for putting the received warp threads into high and low positions to form a plurality of sheds which are open simultaneously so that a plurality of weft threads supplied by the corresponding weft thread presentation device are simultaneously inserted into the plurality of sheds between the warp threads to weave the separate web.

9. A series shed weaving machine in accordance with claim 1 wherein each of the plurality of separate weft thread presentation devices are configured to separately supply weft threads to the one corresponding spaced-apart shed-forming section so that the weft threads travel a distance defined by the corresponding spaced-apart shed-forming section spanning a portion of the length of the weaving rotor.

10. A method for weaving a cloth using a series shed weaving machine which includes a weaving rotor having a plurality of mutually spaced-apart shed-forming sections and a plurality of separate weft thread presentation devices operatively coupled with the weaving rotor, the method comprising the steps of:

rotating the weaving rotor to drive the plurality of spaced-apart shed-forming sections for receiving warp threads; and separately supplying weft threads from each of the plurality of weft thread presentation devices to only one of the plurality of spaced-apart shed-forming sections which corresponds to the weft thread presentation device for weaving a separate web from the warp threads and the weft threads received by the one spaced-apart shed-forming section.

11. A method of weaving a cloth in accordance with claim 10 wherein the step of separately supplying weft threads comprises directing the weft threads from the plurality of weft thread presentation devices in the same direction.

12. A method of weaving a cloth in accordance with claim 10 wherein the step of separately supplying weft threads comprises directing the weft threads from at least one of the plurality of weft thread presentation devices in a first direction and directing the weft threads from a remainder of the plurality of weft thread presentation devices in a second direction opposite from the first direction.

13. A method of weaving a cloth in accordance with claim 10 wherein the step of separately supply weft threads comprises directing the weft threads from each of the plurality of separate weft thread presentation devices to travel a distance defined by the corresponding spaced-apart shed-forming section spanning a portion of the length of the weaving rotor.

* * * * *